United States Patent [19]

Matsushiro et al.

[11] Patent Number: 4,755,847

[45] Date of Patent: Jul. 5, 1988

[54] ELECTROSTATIC LATENT IMAGE DEVELOPING APPARATUS

[75] Inventors: Hiroyuki Matsushiro, Kanagawa; Toshio Kaneko, Tokyo; Fuchio Takeda, Kanagawa; Yoshihiro Ogata, Kanagawa; Toshihiko Takaya, Kanagawa; Atsushi Shinozaki, Chiba, all of Japan

[73] Assignee: Ricoh Company, Ltd., Tokyo, Japan

[21] Appl. No.: 899,325

[22] Filed: Aug. 22, 1986

[30] Foreign Application Priority Data

Aug. 23, 1985 [JP] Japan ..... 60-185279

[51] Int. Cl.[4] ..... G03G 15/08

[52] U.S. Cl. ..... 355/3 DD; 355/14 D; 355/15

[58] Field of Search ..... 355/3 DD, 14 D, 15

[56] References Cited

U.S. PATENT DOCUMENTS 4,373,798 2/1983 Tsukada et al. ..... 355/14 D X 4,566,776 1/1986 Kondoh ..... 355/3 DD

*Primary Examiner*—A. C. Prescott

*Attorney, Agent, or Firm*—Oblon, Fisher, Spivak, McClelland & Maier

[57] ABSTRACT

An electrostatic latent image developing apparatus supplies toner to a latent image carrier such as a drum-shaped photosensitive body to visualize a latent image formed thereon. The toner is supplied by a rotating drum-shaped toner carrier having a portion confronting the photosensitive body adjacent thereto and another portion held in contact with toner contained in a toner container. The toner is electrostatically attracted to the toner carrier and transferred therefrom to the photosensitive body. The toner on the toner carrier is regulated into a thin toner layer by a toner layer regulating member that is resiliently held in sliding contact with the toner carrier. To prevent toner deposits from being attached to the toner layer regulating member, the toner layer regulating member is made of a material adapted to wear with the attached toner. In order to provide the toner layer regulating member with an ability to triboelectrically charge toner, whether chargeable to a polarity (−) or (+), or to control the amount of electricity on toner chargeable to a polarity (−) or (+) and prevent toner deposits from being attached to the toner layer regulating member, another material to control the amount of electricity on toner is mixed in the material which can be worn with the attached toner.

30 Claims, 3 Drawing Sheets

ELECTROSTATIC LATENT IMAGE DEVELOPING APPARATUS

BACKGROUND OF THE INVENTION

1. Field of the Invention

The present invention relates to an apparatus for developing electrostatic latent images.

2. Description of the Prior Art

Various electrophotographic systems have been known and are being proposed for developing electrostatic latent images on latent image carriers into visible images.

According to one known electrostatic latent image developing system, one-component toner, i.e., a powder developer comprising only toner without carrier particles, is placed as a thin layer on a toner carrier and moved into a developing section by rotating the toner carrier, so that an electrostatic latent image can be developed by the toner. For good image development, the thin toner layer on the toner carrier must be uniform in thickness and electrically charged uniformly. To hold the toner as a thin layer on the toner carrier, a member for regulating a toner layer thickness is resiliently pressed against the toner carrier through the toner. As time goes on, however, the toner tends to be attached to the toner layer regulating member, and surface irregularities are formed by the attached toner on the contact portion or edge of the toner layer regulating member which contacts the toner layer surface to make the same even, thus failing to form a toner layer having a uniform thickness. The surface of the toner layer which is contacted by the toner layer regulating member with irregular toner deposits thereon then has small grooves and ridges. The grooves will appear as white stripes and the ridges as black stripes on a developed visible image, which greatly impair the quality of the image.

To prevent the toner from being attached as irregular toner deposits to the toner layer regulating member, it has been proposed to form the edge of the toner layer regulating member, which is held against the toner carrier through the toner layer, of a material that can easily be worn by abrasive contact with the toner. The idea is that the edge of the toner layer regulating member would be worn by frictional contact with the toner while forming a thin layer thereof on the toner carrier, and no toner would be deposited on the edge of the toner layer regulating member.

However, white and black stripes are nevertheless formed by the toner layer regulating member with the easily wearable edge. At the time such white and black stripes are produced, the toner layer regulating member is checked and it is found that toner has been deposited on the easily wearable edge of the toner layer regulating member. Before such toner deposits are formed, it is also found that the toner layer regulated by the toner layer regulating member is irregular in thickness.

One latent image developing apparatus that has heretofore been proposed comprises a photosensitive drum serving as a latent image carrier, a toner container of one-component toner, and a drum-shaped toner carrier disposed between the photosensitive drum and the toner container. The apparatus also includes a toner layer regulating member in the form of a thin plate having at least a distal edge formed of an easily wearable material, the toner layer regulating member being pressed against the toner carrier under spring forces. As the toner carrier rotates about its own axis, toner placed thereon is formed into a thin layer by the toner layer regulating member, and at the same time electrically charged to such a polarity and extent that are required for latent image development. The toner layer is supplied and electrostatically attracted to the photosensitive drum to visualize the latent image thereon.

The toner layer regulating member with the easily wearable edge has however proven unsatisfactory for the reason described above.

Where the toner layer regulating member is made of metal, it is advantageous in that it has a relatively intermediate charging capability with respect to toner of a polarity (−) and toner of a polarity (+), and can be used with both polarities, and that a suitable metallic material of low hardness and easy wearability can be used. However, since metal is generally poor in resiliency, it is difficult for the metallic toner layer regulating member to form a uniform thin toner layer on the toner carrier, unless the toner layer regulating member is kept highly accurate dimensionally with respect to the toner carrier.

In case the toner layer regulating member is made of synthetic resin, it is resilient and hence free of the above shortcoming. However, inasmuch as the charging capability of synthetic resin is generally for the polarity (+) or (−), it may sometimes fail to meet toner of a certain polarity, and cannot be used with respect to both toner polarities.

Therefore, the toner layer regulating member made of metal only and the toner layer regulating member made of synthetic resin only have their own advantages and disadvantages.

SUMMARY OF THE INVENTION

It is an object of the present invention to provide an electrostatic latent image developing apparatus which prevents toner from being attached to the portion of a toner layer regulating member which contacts a toner carrier, while forming, on the toner carrier, a thin toner layer that has been electrically charged unformly to a desired degree.

To achieve the above object, a toner layer regulating member for regulating the thickness of a toner layer is made of synthetic resin mixed with such a material as to control the amount of electricity to which toner can be electrically charged, the toner layer regulating member having a suitably selected width for contact with toner.

The toner layer regulating member has advantages of both metal and synthetic resin for producing a thin layer of toner which is versatile and reliable. With a material for controlling the amount of electricity to which toner can be electrically charged being mixed with the toner layer regulating member, toner of a polarity (−) and toner of a polarity (+) can stably be charged and regulated into a thin layer by the toner layer regulating member. As a result, sharp images free of background stains can be developed by the toner layer.

The developing apparatus of the invention can form a thin toner layer which is deposited on a toner carrier with a uniform thickness and uniformly electrically charged thereon, without toner attached to the toner layer regulating member. Consequently, the developing apparatus can develop electrostatic latent images stably for a long period of time to produce visible images of good quality.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Embodiment 1

Figure 1:
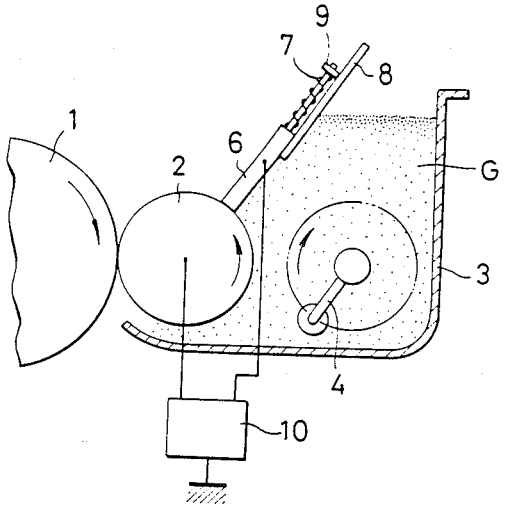
FIG. 1 is a fragmentary schematic side elevational view, partly in cross section, of a developing apparatus according to the present invention.

FIG. 1 shows an electrostatic latent image developing apparatus according to the present invention. The developing apparatus includes a drum-shaped resilient toner carrier 2 pressed against the outer circumferential surface of a photosensitive body 1, the photosensitive body 1 and the toner carrier 2 being rotatable about their own axes in the directions of the arrows. The toner carrier 2 is partly positioned in a toner container 3 such that a circumferential surface of the toner carrier 2 is always held in contact with dry one-component toner G contained in the toner container 3. An agitator 4 disposed in the toner container 3 adjacent to the toner carrier 2 is rotatable for transferring the toner G to the toner carrier 2.

Figure 2:
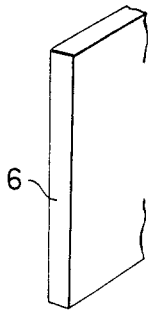
FIG. 2 is a fragmentary perspective view of a toner layer regulating member for regulating the thickness of a toner layer, shown in FIG. 1.

A toner layer regulating member 6 for regulating the thickness of a toner layer on the toner carrier 2 is slidably held edgewise against the circumferential surface of the toner carrier 2 under the resiliency of a compresson coil spring 7. The toner layer regulating member 2 may be in the shape of a plate, as shown in FIG. 2, or a blade. The toner layer regulating member 2 is guided on a fixed guide member 8 to which there is fixed a spring seat 9 engaging one end of the spring 7.

When the toner G passes between the toner carrier 2 and the toner layer regulating member 6, the toner G is electrically charged and deposited as a thin layer on the toner carrier 2. The charged toner layer is then supplied from the toner carrier 2 to the photosensitive body 1.

The toner layer regulating member 6 is made of a mixture of synthetic resin such as nylon 6 or nylon 66 and such a material as to control the amount of electricity to which toner can be electrically charged, such as electrically conductive resin with carbon fiber mixed therein.

As an example, commercial name "NP-200" (nylon 6 containing carbon fiber, manufactured by Toyobo Co., Ltd.) was used as the electrically conductive resin, and the toner layer regulating member was tested for image developing performance under the following conditions:

The photosensitive body 1 used was chargeable to a polarity (+), and the toner G used was chargeable to a polarity (−). A bias voltage of −300 V was applied to the toner layer regulating member 6 with respect to the toner carrier 2 by a power supply 10, and the amount of electricity to which the toner G was electrically charged was checked during operation of the developing apparatus. The toner G was charged to −10 μC/g, and the thin toner layer was uniform. A sharp image free of background stains was formed by the developing apparatus.

Then, the photosensitive body 1 chargeable to a polarity (−), and the toner G chargeable to a polarity (+) were employed. A bias voltage of +300 V was applied to the toner carrier 2 by the power supply 10, and the amount of electricity to which the toner G was electrically charged was checked during operation of the developing apparatus. The toner G was charged to +8 μC/g. A sharp image free of background stains was also formed by the developing apparatus.

It is believed that the thin toner layer was uniform and stable without any undesired toner deposits on the toner layer regulating member 6 since the contact portion or edge thereof was continuously scraped off due to resilicency and wearability of the synthetic resin and wearability of the carbon fiber, producing a new edge surface for contact with the toner carrier 2. It is also believed that the electrical conductivity of the carbon fiber allowed the voltage of the power supply 10 to electrically charge the toner, irrespective of whether it may be chargeable to a polarity (+) or (−), to a sufficient degree.

Figure 3:
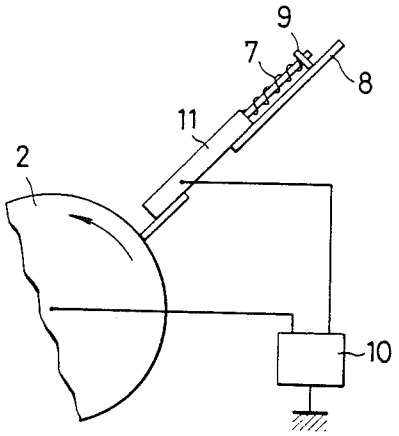
FIG. 3 is a fragmentary schematic side elevational view showing another toner layer regulating member.

As shown in FIG. 1, the toner layer regulating member 6 is directly urged by the presser mechanism in the form of the spring 7 into pressing contact with the toner carrier 2. However, a toner layer regulating member 6 may be bonded or otherwise attached to a support 11 of a presser mechanism, as shown in FIG. 3. In FIG. 3, one terminal of the power supply 10 is electrically connected to the support 11 which is electrically conductive.

Embodiment 2

A developing apparatus according to this embodiment may be of the same construction as shown in FIGS. 1 through 3. However, the biasing power supply 10 may not necessarily be required.

The toner layer regulating member 6 is made of a mixture of synthetic resin and such a material as to control the amount of electricity to which toner can be electrically charged, such as fine metal powder having a Brinell hardness of 50 or lower.

As an example, commercial name "PFA" (perfluoroalkoxy side chain 4-ethylene fluoride, manufactured by Mitsui Fluorochemical Co., Ltd.) with fine metal powder, i.e., copper particles of a particle size in the range of from 1 to 10 micrometers being dispersed therein was used as the material of the toner layer regulating member 6, and the toner layer regulating member 6 was tested for image developing performance under the following conditions:

The toner G chargeable to a polarity (−) which was used was electrically charged to −8 μC/g, and the toner G chargeable to a polarity (+) which was used was electrically charged to +12 μC/g. As a result, sharp images free of background stains were produced irrespective of whether the toner was chargeable to a polarity (−) or (+).

It is believed that the mass of synthetic resin made the toner layer regulating member resilient, and the fine metal powder allowed the toner to be electrically charged.

By applying a bias voltage between the toner carrier 2 and the toner layer regulating member 6 in this embodiment, electric charges are injected into the thin toner layer to electrically charge the same in addition to triboelectric charging thereof.

The reason for the Brinell hardness of 50 or lower for the fine metal powder is to cause the fine metal powder to be worn to the same extent as the synthetic resin mass, thus preventing the circumferential surface of the toner carrier 2.

To illustrate superiority of the above toner layer regulating member, a toner layer regulating member made of synthetic resin only will be described below by way of example.

The toner layer regulating member 6 used was made of PFA only and employed in the same arrangement as shown in FIG. 1 except that the power supply 10 was omitted. The photosensitive body 1 was chargeable to a polarity (−) and the toner G was chargeable to a polarity (+). An image produced by developing an electrostatic latent image on the photosensitive body 1 was sharp, free of background stains. The toner was charged to +20 C/g at this time. Then, the toner chageable to a polarity (−) was used and an electrostatic latent image was developed or reversal development was effected. As a result, an unsharp image with bad backgound stains was formed. At this time, the toner was charged to −1 μC/g or less, i.e., the toner could not sufficiently be charged to a polarity (−).

The synthetic resin which the toner layer regulating member 6 can be made of may be any of the following materials:

(1) PFA (perfluoroalkoxy side chain 4-ethylene fluoride)
Commercial name PFA: manufactured by Mitsui Fluorochemical Co., Ltd.

(2) PTFE (4-ethylene fluoride)
Commercial name NITOFLON: manufactured by Nitto Electric Industrial Co., Ltd.

(3) PVDF (vinylidene fluoride)
Commercial name KYNAR: manufactured by Mitsubishi Petrochemical Co., Ltd.

(4) ETFE (copolymer of 4-ethylene fluoride and ethylene)
Commercial name AFLEX: manufactured by Asahi Glass Co., Ltd.

Electrically conductive fine particles such as copper powder (having a particle size ranging from 1 to 10 micrometers) or carbon powder may be dispersed in any of these resins to control the amount of electricity to which the toner can be electrically charged. Alternatively, the amount of electricity to which the toner can be electrically charged may be controlled by mixing a silicone-based polymer in any of the above resins with compatibility.

As another example, methyl vinyl polysiloxane may be used as synthetic resin which the toner layer regulating member is made of. In this alternative, wet silica is dispersed in this synthetic resin to control the amount of electricity to which the toner can be electrically charged. The amount of electricity to which the toner can be electrically charged can be controlled by changing the amount of wet silica dispersed in the synthetic resin. For example, when the amount of wet silica was 10 wt %, the toner chargeable to a polarity (−) was electrically charged to −3 μC/g, and when the amount of wet silica was 40 wt %, the toner chargeable to a polarity (−) was electrically charged to −11 μC/g.

Embodiment 3

According to an electrostatic latent image developing apparatus of this embodiment, one-component toner is held as a thin layer on a toner carrier and transferred by rotation of the toner carrier to a developing section for developing an electrostatic latent image on a latent image carrier.

The one-component toner comprises a powder developer composed of toner only without containing carrier particles. The toner may be either magnetic or nonmagnetic.

The toner carrier is rotatable and may be in the form of a roller (including a drum) or a belt.

The latent image carrier may be photoconductive or dielectric, and electrostatic latent images may be formed thereon in any way. That is, an electrostatic latent image formed by electric charging or exposure to light on a photoconductive photosensitive body may be developed, or an electrostatic latent image formed by needle electrodes or the like on a dielectric latent image carrier may be developed.

A toner layer regulating member for regulating the thickness of a toner layer is resiliently held against the circumferential surface of the toner carrier through toner for forming a thin toner layer on the toner carrier. The contact portion or edge of the toner layer regulating member which is held against the toner carrier is made of a wearable material. The inventors have studied the problem of toner attached to the wearable edge of toner layer regulating members, and have found that such attached toner is governed by the width of the edge of the toner layer regulating member contacting the toner carrier, i.e., the smaller the contacting width, the smaller the amount of attached toner and the more uniform the toner thickness.

According to the present invention, the width of the contacting edge which is made of a wearable material is 1.2 mm or smaller. The wearable material may be PFE, PTFE, Si, nylon 6, nylon 66, etc.

Figure 4:
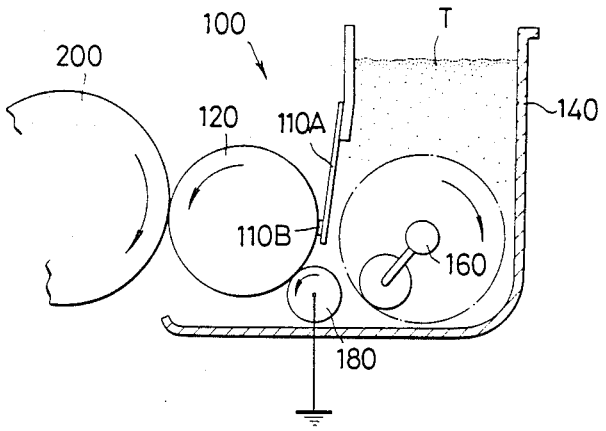
FIG. 4 is a fragmentary schematic side elevational view of a developing apparatus according to another embodiment of the present invention.

FIG. 4 illustrates such an embodiment of the present invention. A latent image carrier 200 is in the form of a drum-shaped photoconductive photosensitive body for forming electrostatic latent images on its circumferential surface, the latent image carrier 200 being rotatable in the direction of the arrow about its own axis.

An electrostatic latent image developing apparatus 100 generally comprises a toner carrier 120, a toner container 140, an agitator 160, a roller 180, a resilient support plate 110A, and a contact member 110B.

The toner carrier 120 is in the form of a roller having a resilient circumferential surface and rotatable in the direction of the arrow about its own axis. The toner container 140 contains one-component toner T. The agitator 160 is disposed in the toner container 140 and rotatable in the direction of the arrow. The roller 180 is electrically conductive and grounded, and rotatable about its own axis in the direction of the arrow while in contact with the toner carrier 120.

The contact member 110B, which is mounted on a distal end of the resilient support plate 110A, serves as a toner layer regulating member. The contact member 110B has a contact portion for contacting the toner carrier 120 and is made of a wearable material.

The contact member 110B is fixed to one side of a free marginal edge of the resilient support plate 110A and extends in a direction normal to the sheet of FIG. 4. The edge of the contact member 110B which is opposite to the free marginal edge thereof is secured to a side wall of the toner container 140. Although not clearly shown in FIG. 4, the resilient support plate 110A is slightly resiliently flexed to keep the contact member 110B in resiliently pressing contact with the circumferential surface of the toner carrier 120 along its generatrix.

Figure 5:
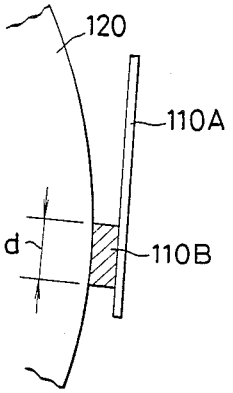
FIG. 5 is an enlarged fragmentary side elevational view of a toner layer regulating member illustrated in FIG. 4.

As shown in FIG. 5, the contact member 110B has a contact width d across which the contact member 110B and the toner carrier 120 contact each other, the contact width d being selected to be 1.2 mm or less. The lower limit of the contact width d is generally about 0.3 mm, and preferably in the range of from 0.4 to 0.7 mm, although it depends on the material and thickness of the contact member 110B.

Operation of the developing device 100 shown in FIG. 4 will hereinafter be described briefly.

During image development, the toner carrier 120, the agitator 160, and the roller 180 are rotated in the directions of the respective arrows. The rotation of the agitator 160 displaces the toner T toward the roller 180, which transfers the displaced toner T toward the circumferential surface of the toner carrier 120. When the toner T contacts the circumferential surface of the toner carrier 120, it is triboelectrically charged by friction with the toner carrier 120 and attached thereto. The toner T attached to the toner carrier 120 is moved with the rotation thereof and its surface is uniformized by the toner layer regulating member to form a thin toner layer, which is simultaneously triboelectrically charged. The toner layer is generally triboelectrically charged to a polarity opposite to that of an electrostatic latent image on the latent image carrier 200, but may be charged to the same polarity as that of the electrostatic latent image for reversal image development.

The charged toner layer is then moved with the rotation of the toner carrier 120 into a developing section in which it develops the electrostatic latent image on the latent image carrier 200. At this time, a bias voltage is applied between the toner carrier 120 and the latent image carrier 200.

As the toner carrier 120 is further rotated, the charge on any remaining toner T on the toner carrier 120 is erased, and the remaining toner T is scraped off the circumferential surface of the toner carrier 120. The exposed circumferential surface of the toner carrier 120 is coated again with a new thin toner layer, as described above.

Embodiment 4

Figure 6:
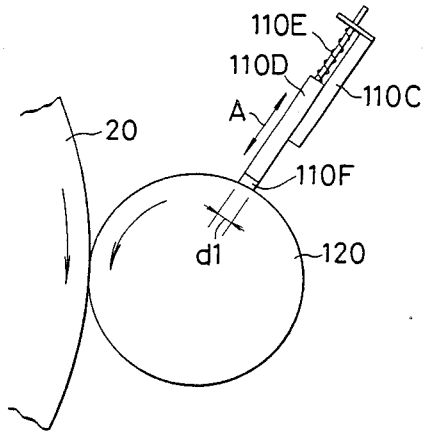
FIG. 6 is a side elevational view of a presser for a toner layer regulating member.

FIG. 6 show still another embodiment of the present invention. Those parts which are not illustrated in FIG. 6 are identical to those shown in FIG. 4, and a toner carrier and a latent image carrier are also identical to those of FIG. 4 and hence denoted by 120, 200, respectively. The embodiment of FIG. 6 differs from that of FIG. 4 as to the toner layer regulating member.

In FIG. 6, a contact member 110F serving as a toner layer regulating member is supported by a holder 110C, a support plate 110D, and a compression spring 110E. The holder 110C is fixed to an immovable member such as hopper, and the support plate 110D is supported on the holder 110C for movement in the direction of the arrow A. The compression spring 110E acts between the holder 110C and the support plate 110D for normally urging the support plate 110D resiliently toward the toner carrier 120. The contact member 110F is fixed to an edge of the support plate 110D and extends in a direction normal to the sheet of FIG. 6, the contact member 110F being made of a wearable material. The contact member 110F is held in resiliently pressing contact with the toner carrier 120 under the force of the spring 110E. The contact member 110F has a contact width dl which is 1.2 mm or less.

Figure 7:
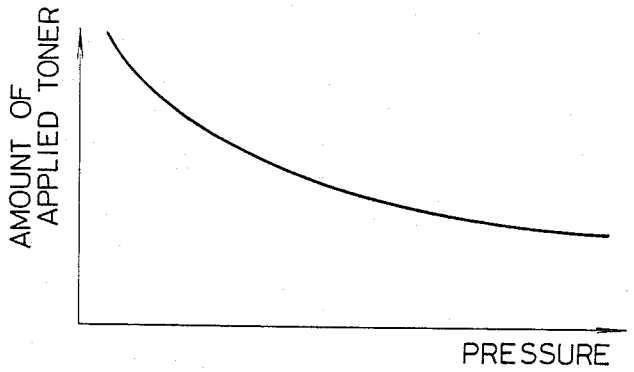
FIG. 7 is a graph showing the relationship between the pressure on a toner layer regulating member and the amount of toner applied to a toner carrier.

FIG. 7 shows how the amount of toner applied to the toner carrier (per unit area) varies with the pressure imposed on the contact portion of the toner layer regulating member of the electrostatic image developing apparatus. As illustrated in FIG. 7, a desired amount of toner can be applied to the toner carrier by regulating the pressure on the toner layer regulating member.

Figure 8:
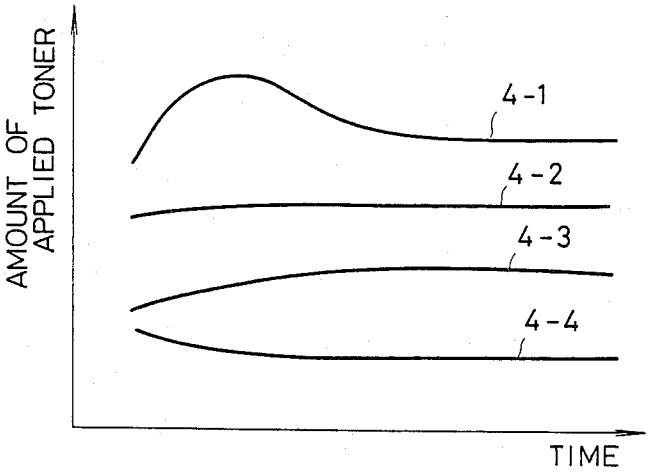
FIG. 8 is a graph illustrating time-dependent changes in the amounts of toner applied to a toner carrier.

FIG. 8 illustrates how the amount of toner applied to the toner carrier (per unit area) varies with time, with the pressure being used as a parameter. The pressures P1, P2, P3, P4 applied in plotting curves 4-1, 4-2, 4-3, 4-4 are of the relationship: $P1<P2<P3<P4$. Any of these curves indicate that the amount of applied toner remains stable even if the contact portion wears with time. The pressure values P1, P2, P3, P4 vary dependent on the combination of the material of the contact portion and the material of the circumferential surface of the toner carrier.

Two specific examples are given in the following table:

| Wearable material of contact portion | Material of surface of toner carrier | Pressure (g/cm2) | | | |
|---|---|---|---|---|---|
| | | P1 | P2 | P3 | P4 |
| PFE (contact width: 0.6 mm) | Si | 4.8 | 8.0 | 13.5 | 21.7 |
| Si (contact width: 1.2 mm) | Acr layer | 7.0 | 26.0 | 43.0 | 60.0 |

The toner carrier in the first example comprises a metallic roller having a circumferential surface covered with Si rubber. The toner carrier in the second example comprises a metallic roller covered with a layer of Si rubber which is also covered with an acrylic layer. The acrylic layer may be replaced with a urethane resin layer.

The Si rubber may be replaced with nitrile rubber, acrylic rubber, urethane rubber, chloroprene rubber, styrene rubber, or isoprene rubber.

Although certain preferred embodiments have been shown and described, it should be understood that many changes and modifications may be made therein without departing from the scope of the appended claims.

We claim:

1. An electrostatic latent image developing apparatus comprising:

a latent image carrier;

a toner container for containing toner;

a toner carrier disposed between said latent image carrier and said toner container;

a toner layer regulating member held in slidable contact with said toner carrier for forming a thin toner layer on said toner carrier while the toner layer is being supplied to said latent image carrier in response to movement of the toner carrier;

said toner layer regulating member having a contact portion held in slidable contact with said toner carrier and made of a mixture of a wearable adapted to wear material and a material to control the amount of electricity to which the toner can be electrically charged, said contact portion having a width across which it is held in slidable contact with said toner carrier.

2. An electrostatic latent image developing apparatus as claimed in claim l, wherein said latent image carrier is photoconductive.

3. An electrostatic latent image developing apparatus as claimed in claim l, wherein said latent image carrier is dielectric.

4. An electrostatic latent image developing apparatus as claimed in claim l, wherein said latent image carrier is in the form of a drum.

5. An electrostatic latent image developing apparatus as claimed in claim l, wherein said latent image carrier is in the form of a belt.

6. An electrostatic latent image developing apparatus as claimed in claim l, wherein said toner container includes an agitator disposed therein for agitating the toner contained therein.

7. An electrostatic latent image developing apparatus as claimed in claim 1, wherein said toner carrier is rotatable.

8. An electrostatic latent image developing apparatus 7, wherein said toner carrier is in the form of a roller.

9. An electrostatic latent image developing apparatus as claimed in claim 7, wherein said toner carrier is in the form of a drum.

10. An electrostatic latent image developing apparatus as claimed in claim 7, wherein said toner carrier is in the form of a belt.

11. An electrostatic latent image developing apparatus as claimed in claim 8, wherein said toner carrier comprises a metallic roller having a circumferential surface covered with synthetic rubber.

12. An electrostatic latent image developing apparatus as claimed in claim 8, wherein said toner carrier comprises a metallic roller having a circumferential surface covered with a layer of synthetic rubber covered with a layer of urethane resin.

13. An electrostatic latent image developing apparatus as claimed in claim 8, wherein said toner carrier comprises a metallic roller having a circumferential surface covered with a layer of synthetic rubber covered with an acrylic layer.

14. An electrostatic latent image developing apparatus as claimed in claim 1, wherein said toner comprises dry one-component toner.

15. An electrostatic latent image developing apparatus as claimed in claim l4, wherein said dry one-component toner comprises magnetic toner without any carrier particles contained.

16. An electrostatic latent image developing apparatus as claimed in claim 14, wherein said dry one-component toner comprises nonmagnetic toner without any carrier particles contained.

17. An electrostatic latent image developing apparatus as claimed in claim 1, further including a pressing mechanism comprising a coil spring for nornally urging said toner layer regulating member to directly contact said toner carrier.

18. An electrostatic latent image developing apparatus as claimed in claim 17, wherein said pressing mechanism includes a support, said toner layer regulating member being mounted on said support, said support being normally urged by said coil spring to hold said toner layer regulating member in contact with said toner carrier.

19. An electrostatic latent image developing apparatus as claimed in claim 1, further including a resilient support plate having a fixed edge, said toner layer regulating member being mounted on an opposite free edge of said resilient support plate, said resilient support plate being resiliently flexed to keep said toner layer regulating member in resiliently pressing contact with said toner carrier.

20. An electrostatic latent image developing apparatus as claimed in claim 1, wherein said toner layer regulating member has a width across which it is held in slidable contact with said toner carrier, said width being at most 1.2 mm.

21. An electrostatic latent image developing apparatus as claimed in claim 1, wherein said wearable material is synthetic resin.

22. An electrostatic latent image developing apparatus as claimed in claim 21, wherein said material to control the amount of electricity to which the toner can be electrically charged is electrically conductive resin with carbon fiber mixed therein.

23. An electrostatic latent image developing apparatus as claimed in claim 22, wherein said electrically conductive resin comprises nylon 6 containing carbon fiber.

24. An electrostatic latent image developing apparatus as claimed in claim 1, wherein said latent image carrier comprises a photosensitive body, said photosensitive body being electrically chargeable to a polarity (+), said toner being electrically chargeable to a polarity (−), the arrangement being such that a bias voltage of −300 V will be applied to said toner layer regulating member.

25. An electrostatic latent image developing apparatus as claimed in claim 1, wherein said latent image carrier comprises a photosensitive body, said photosensitive body being electrically chargeable to a polarity (−), said toner being electrically chargeable to a polarity (+), the arrangement being such that a bias voltage of +300 V will be applied to said toner carrier.

26. An electrostatic latent image developing apparatus as claimed in claim 21, wherein said material to control the amount of electricity to which the toner can be electrically charged is fine metallic powder having a Briness hardness up to 50.

27. An electrostatic latent image developing apparatus as claimed in claim 26, wherein said toner layer regulating member has a contact portion slidably contacting said toner carrier, said contact portion being made of a (perfluoroalkoxy side chain 4-ethylene fluoride, with copper particles of a particle size in the range of from 1 to 10 micrometers being dispersed therein as said material to control the amount of electricity to which the toner can be electrically charged.

28. An electrostatic latent image developing apparatus as claimed in claim 2l, wherein said material to control the amount of electricity to which the toner can be electrically charged is wet silica.

29. An electrostatic latent image developing apparatus as claimed in claim 28, wherein said toner layer regulating member has a contact portion slidably contacting said toner carrier, said contact portion being made of silicone resin.

30. An electrostatic latent image developing apparatus as claimed in claim 1, wherein said toner layer regulating member comprises a plate.

* * * * *